US007398135B2

(12) United States Patent
Ogawa et al.

(10) Patent No.: US 7,398,135 B2
(45) Date of Patent: Jul. 8, 2008

(54) METHOD FOR SIMULATING CONVEYANCE OF MEDIUM

(75) Inventors: Masahiko Ogawa, Ohta-ku (JP); Tatsuro Kawakami, Ohta-ku (JP)

(73) Assignee: Canon Kabushiki Kaisha, Tokyo (JP)

( * ) Notice: Subject to any disclaimer, the term of this patent is extended or adjusted under 35 U.S.C. 154(b) by 562 days.

(21) Appl. No.: 10/731,967

(22) Filed: Dec. 9, 2003

(65) Prior Publication Data

US 2004/0122551 A1 Jun. 24, 2004

(30) Foreign Application Priority Data

Dec. 12, 2002 (JP) ..... 2002-360890

(51) Int. Cl.
*G06F 7/00* (2006.01)
*G05B 19/18* (2006.01)
*G05B 13/02* (2006.01)

(52) U.S. Cl. ..... 700/230; 700/29; 700/5

(58) Field of Classification Search ..... 700/230, 700/214, 213, 28–63; 703/7
See application file for complete search history.

(56) References Cited

U.S. PATENT DOCUMENTS 5,838,596 A * 11/1998 Shimomura et al. ..... 703/6
6,179,954 B1 * 1/2001 Kawana et al. ..... 156/345.21
6,445,969 B1 * 9/2002 Kenney et al. ..... 700/108
6,549,745 B2 * 4/2003 May et al. ..... 399/302
6,950,787 B2 * 9/2005 Hashima et al. ..... 703/2
2002/0176722 A1 * 11/2002 Iijima et al. ..... 399/167

FOREIGN PATENT DOCUMENTS

JP 11-116133 A 4/1999
JP 11-195052 A 7/1999

OTHER PUBLICATIONS

K. Yoshida, Dynamic Analysis of Sheet Deformation Using Spring-Mass-Beam Model, Trans. of the JP Soc. of Mechanical Engineers Series C, vol. 63, No. 615, (Nov. 1997) p. 230-236.

* cited by examiner

*Primary Examiner*—Gene O. Crawford
*Assistant Examiner*—Ramya G. Prakasam
(74) *Attorney, Agent, or Firm*—Canon U.S.A. Inc., IP Division

(57) ABSTRACT

A method for simulating the behavior of a flexible medium which is conveyed along a conveying path constructed of a pair of conveyor rollers includes the steps of dividing the surfaces of the conveyor rollers into a contact region and a non-contact region and setting a first peripheral speed and a second peripheral speed for the contact region and the non-contact region, respectively, and performing a simulation under a condition that a conveying force corresponding to the difference between the second peripheral speed and a moving speed of the flexible medium is applied to the flexible medium when the flexible medium reaches the non-contact region of the conveyor rollers and a condition that the flexible medium is conveyed at the first peripheral speed when the flexible medium reaches the contact region of the conveyor rollers.

10 Claims, 15 Drawing Sheets

METHOD FOR SIMULATING CONVEYANCE OF MEDIUM

BACKGROUND OF THE INVENTION

1. Field of the Invention

The present invention relates to a technique for the optimal design of a conveying path for a paper sheet based on a computer-simulation analysis of the paper sheet's behavior in a copy machine, a printer, or the like.

2. Description of the Related Art

In the design of a conveying path for paper sheets in a copy machine, a laser beam printer (LBP), or the like, the number of processes required for manufacturing test products and performing tests and the time and cost of development can be reduced by analyzing the functions of the conveying path under various conditions.

As an example of a technique for simulating the behavior of a flexible medium (a sheet-shaped recording medium such as a piece of paper and a film) in a conveying path, Japanese Patent Laid-Open Nos. 11-195052 and 11-116133 disclose design support systems in which the resistance and the contact angle between the flexible medium and a guide are evaluated by modeling the flexible medium with finite elements using the finite element method, and determining whether the flexible medium is in contact with guides and rollers in the conveying path, by numerically solving a dynamic equation.

In addition, Dynamic Analysis of Sheet Deformation Using Spring-Mass-Beam Model is also disclosed (Kazushi Yoshida, Transaction of the Japan Society of Mechanical Engineers, Vol. 63, No. 615C(1997-11), P230-236 Thesis No. 96-1530).

The motion of the flexible medium can be determined by deriving a dynamic equation of the flexible medium modeled with discrete finite elements or mass-spring elements, dividing the analysis time interval into time steps with a finite width, and successively determining unknown values of the acceleration, the speed, and the displacement for each time step by numerical time integration starting from time zero. For example, the Newmark β method, the Wilson θ method, the Euler method, the Kutta-Merson method, etc., are known in the art.

In the known design support systems for the conveyance of the flexible medium, the flexible medium is modeled with a finite number of elements (finite elements or mass-spring elements). A coefficient of friction μ which depends on the difference between the speed of conveyor rollers and the speed of the flexible medium, as shown in FIG. 2, is defined for each of the representative points of the elements (mass points if the elements are the mass-spring elements), and the motion of the flexible medium is calculated under a condition including a conveying force obtained as the product μN of the coefficient of friction μ and the normal force N.

A motion-calculation method used in the known design support systems for the conveyance of the flexible medium will be described below with reference to FIGS. 17 to 19. FIGS. 17 to 19 show a typical manner in which the flexible medium is conveyed. In FIG. 17, reference numerals 31, 32, and 33 denote mass points, reference numerals 34 and 35 denote springs positioned between the mass points, reference numeral 36 denotes a drive conveyor roller, and reference numeral 37 denotes a driven conveyor roller. Similarly, in FIGS. 18 and 19, reference numerals 41, 42, and 43 and reference numerals 51, 52, and 53 denote mass points.

In this calculation method, the difference ΔV between the conveying speed Vr of the rollers and the conveying speed Vp of the medium at the time when the mass point 31 reaches the contact point (nipping region) between the rollers is calculated as follows:

$$\Delta V = Vr - Vp$$

Then, the coefficient of friction μ is determined from FIG. 2 on the basis of the calculated ΔV, and the conveying force F=μN is calculated on the basis of a pressing force N applied by the driven roller 37. Thus, the conveying force F is applied to the mass point 31.

The conveying force F further conveys the medium, and the state shown in FIG. 18 is obtained. The conveying force F calculated on the basis of the state shown in FIG. 17 is assumed to be applied continuously to the mass point 41 until the next mass point 42 enters the nipping region. As shown in FIG. 19, when the next mass point 52 enters the nipping region, the conveying force F is updated and a new conveying force F' is calculated on the basis of Vr and Vp at this time.

When the above-described calculation method is used, a large force is assumed to be applied to the mass point even when ΔV is small, and therefore the calculation result of the medium's speed greatly varies. In addition, the force applied is assumed to be constant while the state of the medium changes from that shown in FIG. 17 to that shown in FIG. 19. Therefore, even when the peripheral speed Vr of the rollers is set constant, the conveying speed Vp of the medium varies periodically unless the number of elements into which the medium is divided is considerably increased and the width of the time steps is considerably reduced.

In addition, if a relatively large external force is suddenly applied to the medium from a guide or another roller, etc., when no mass point is in the nipping region, as shown in FIG. 18, the medium cannot resist such a force and false slipping occurs between the medium and the rollers.

SUMMARY OF THE INVENTION

In view of the above-described situation, a feature of the present invention is to provide a method for simulating the conveyance of a medium in which the conveying speed of the medium is accurately simulated using a stable, forced speed as a conveyance condition under which the medium is conveyed by the conveyor rollers.

In order to attain the above-described feature of the present invention, according to one aspect of the present invention, a method for simulating the behavior of a flexible medium which is conveyed along a conveying path constructed of a pair of conveyor rollers includes the steps of dividing the surfaces of the conveyor rollers into a contact region and a non-contact region and setting a first peripheral speed and a second peripheral speed for the contact region and the non-contact region, respectively, the first and the second peripheral speeds being different from each other, and performing a simulation under a condition, which requires that a conveying force corresponding to the difference between the second peripheral speed and a moving speed of the flexible medium be applied to the flexible medium when the flexible medium reaches the non-contact region of the conveyor rollers. Simulation is also performed under a condition that requires that the flexible medium is conveyed at the first peripheral speed when the flexible medium reaches the contact region of the conveyor rollers.

Further features and advantages of the present invention will become apparent from the following description of the preferred embodiments with reference to the attached drawings.

DESCRIPTION OF THE PREFERRED EMBODIMENTS

Figure 20:
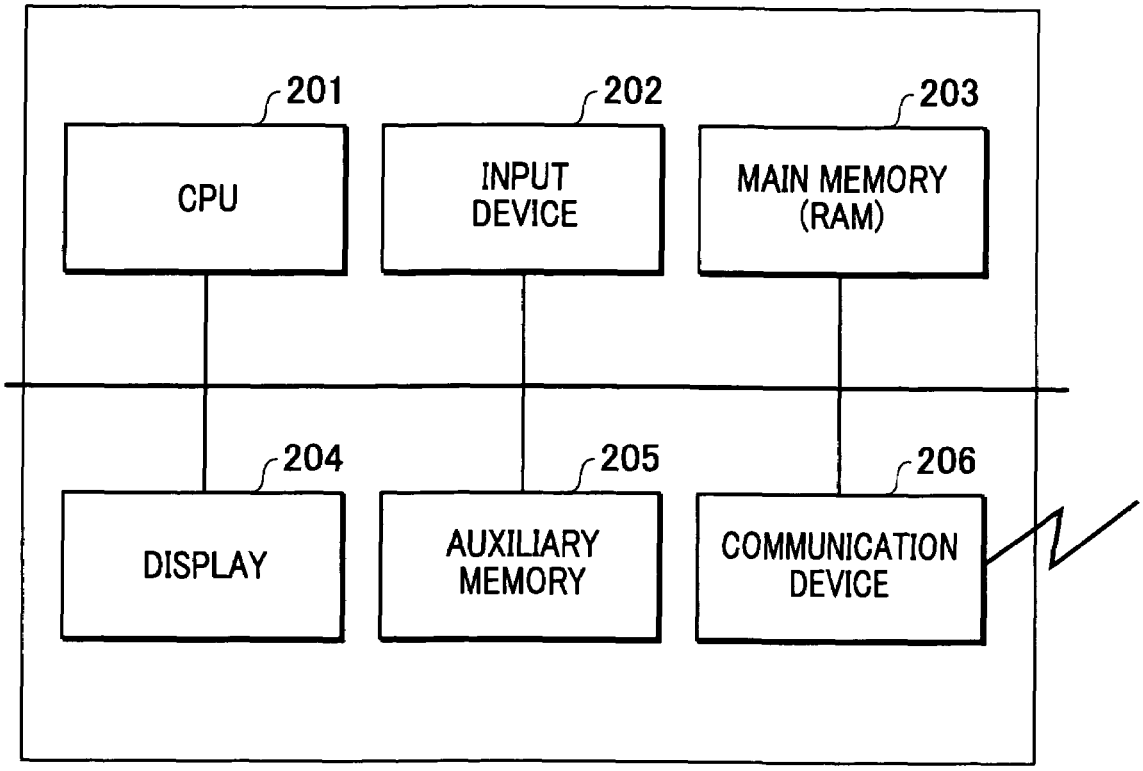
FIG. 20 is a block diagram showing the construction of a terminal which runs a system for simulating the conveyance of the medium according to the first embodiment.

FIG. 20 is a block diagram showing the construction of a terminal which runs a system for simulating the conveyance of a medium according to a first embodiment of the present invention.

A central processing unit (CPU) 201 performs the overall control of the terminal on the basis of programs expanded in a main memory 203. An input device 202 is a pointing device such as a keyboard, a mouse, etc. The main memory 203 is constructed of a random access memory (RAM) or the like and serves as a work memory for, for example, expanding the programs. A display 204 is constructed of a cathode-ray tube (CRT) monitor, a liquid crystal display, or the like. An auxiliary memory 205 is constructed of a hard disk drive or the like and stores various programs for operating a server (or the terminal) and various databases. A communication device 206 is an interface for providing connection to a network.

Figure 1:
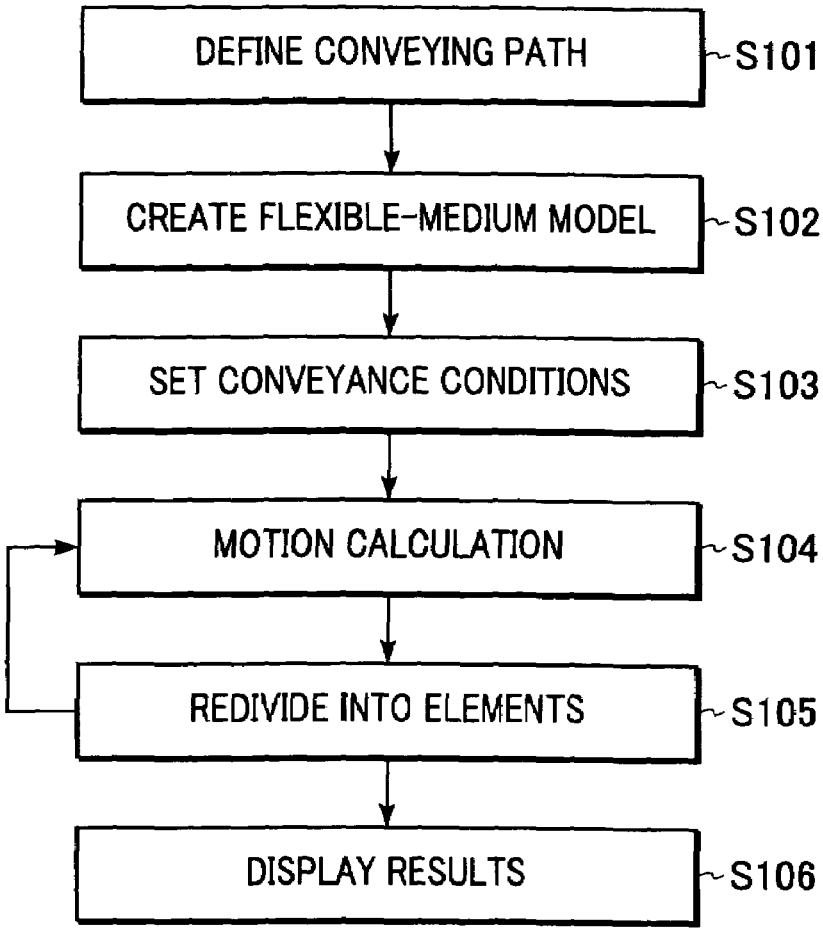
FIG. 1 is a flowchart of a process of simulating the conveyance of a flexible medium according to a first embodiment of the present invention.
Figure 3:
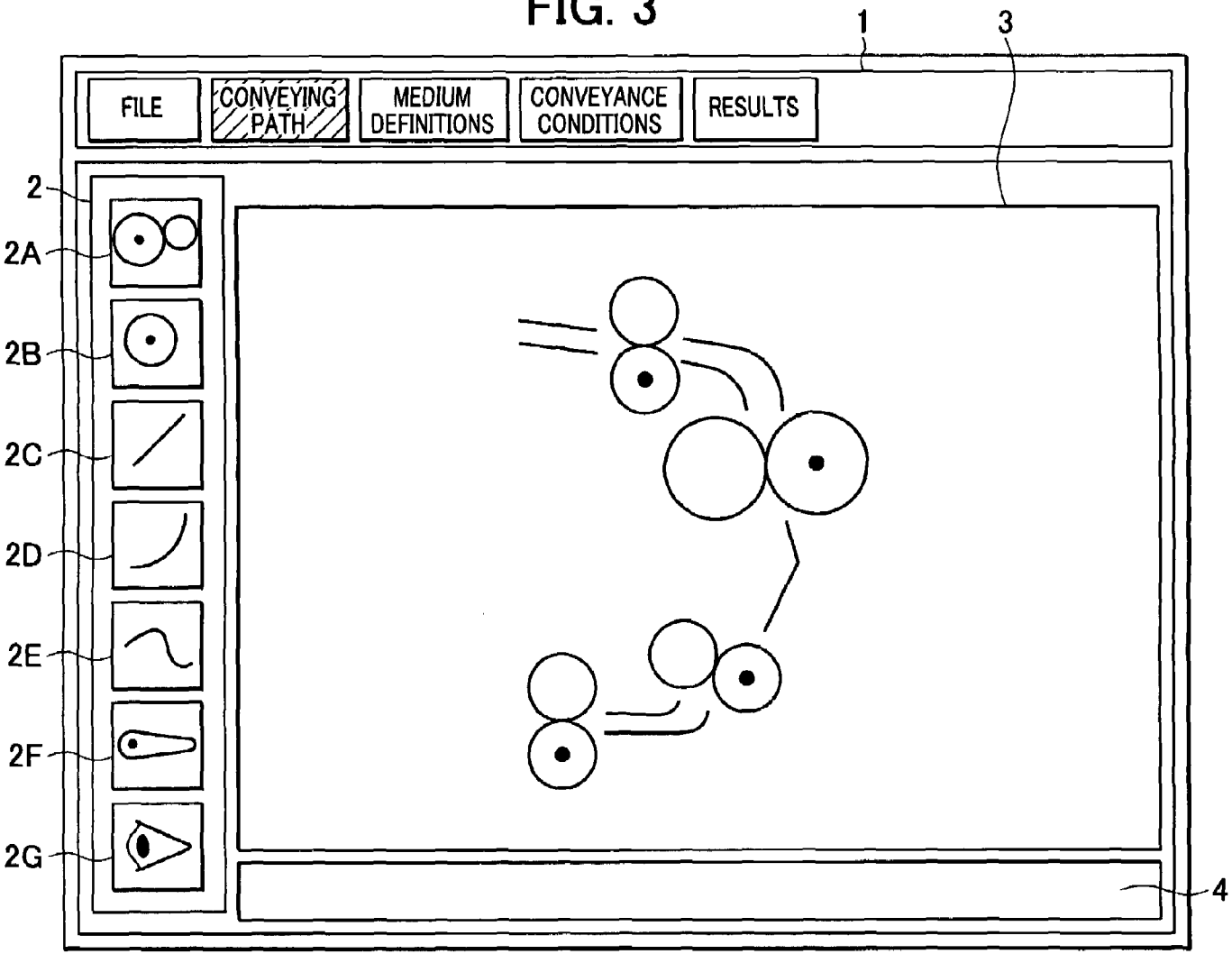
FIG. 3 is a diagram showing an example of a screen displayed in a step of defining a conveying path according to the first embodiment.

FIG. 1 is a flowchart of a process of simulating the conveyance of a medium in a design support system for the conveyance of the medium according to the present embodiment. As shown in FIG. 1, the process of simulating the conveyance of the medium includes several steps. FIG. 3 shows an example of a screen displayed on the display 204 in each of the steps. The screen mainly includes a menu bar 1 for changing the contents on the screen, a sub menu 2 provided for each menu, a graphic screen 3 in which a defined conveying path and results are shown, and a command column 4 in which a message from the system is output and numeric values are input as necessary. Each of the steps will be described below.

Defining Conveying Path

First, a step of defining a conveying path (Step 101) will be described below. When a "conveying path" button is selected from the menu bar 1 in order to define the conveying path, a sub menu 2 for defining the conveying path is displayed, as shown in FIG. 3. The sub menu 2 shown in FIG. 3 includes a roller-pair button 2A for defining two conveyor rollers as a pair, a roller button 2B for defining a single roller, a linear-guide button 2C for defining a linear conveyor guide, an arc-guide button 2D for defining an arc conveyor guide, a spline-guide button 2E for defining a conveyor guide with a spline curve, a flapper button 2F for defining a flapper (point) which switches the conveying path along which the flexible medium is conveyed, and a sensor button 2G for defining a sensor which detects whether the flexible medium is at a predetermined position in the conveying path. Thus, the sub menu 2 includes buttons corresponding to components for constructing the conveying path of actual copy machines and printers.

When the components are defined using the sub menu 2, the shape and position of the defined conveying path is displayed on the graphic screen 3. The positions of the conveyor rollers of each pair defined in this step are the initial positions which do not reflect the displacement between the axes of the conveyor rollers caused by a pressing member such as a spring.

Creating Flexible-Medium Model

When the step of defining the conveying path (Step 101) is finished, a step of creating a flexible-medium model (Step 102 ) is performed. The step of creating the flexible-medium model is initiated when the "medium definitions" button is selected from the menu bar 1 shown in FIG. 4, and a medium-selection screen 2H and a dividing-method-selection screen 2I are shown in the sub menu 2 at the same time.

Figure 4:
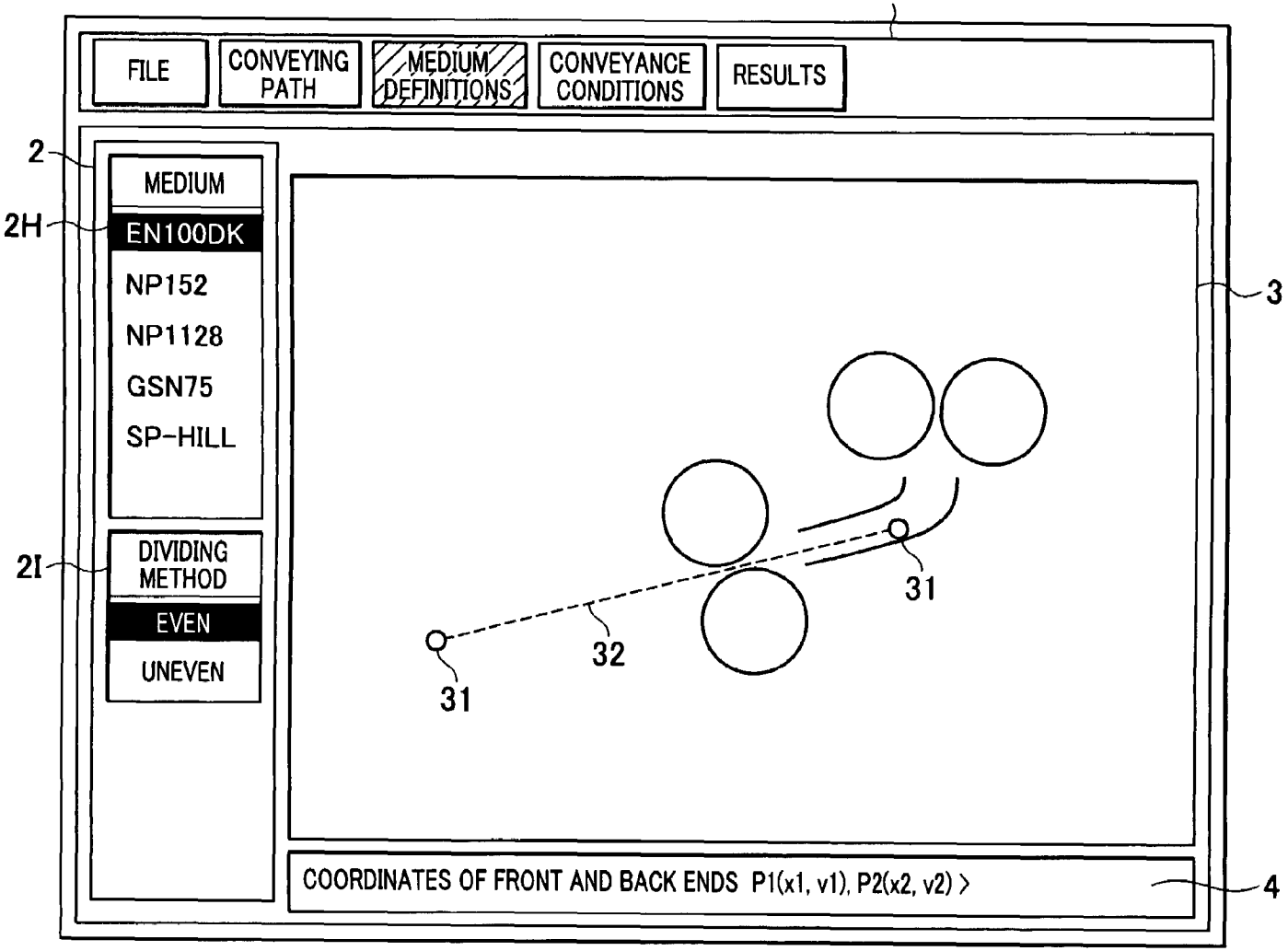
FIG. 4 is a diagram showing an example of a screen displayed in a step of defining the flexible medium according to the first embodiment.

First, in order to determine the position of the flexible medium in the conveying path, a message prompting the user to input the coordinates of both ends of the flexible medium is displayed in the command column 4. The coordinates may be input by inputting numeric values in the command column 4 or directly pointing at the coordinate positions on the graphic screen 3 with the pointing device, such as a mouse, attached to the computer. When the coordinates of both ends are input, a line (dashed line) 32 which connects the two ends 31 is drawn on the graphic screen 3, as shown in FIG. 4, so that the manner in which the flexible medium is disposed in the conveying path can be observed.

Next, a message prompting the user to input the number of elements n used when the flexible medium shown by the line (dashed line) 32 is divided into a plurality of discrete mass-spring elements is displayed in the command column 4, and the number of elements n is input in the command column 4 accordingly. In the present embodiment, the exemplary number of elements n is 10.

In addition, the names of the major kinds of flexible media are registered in advance and are shown in the medium-selection screen 2H, and the kind of the flexible medium to be analyzed is selected by clicking on it. Calculation parameters necessary for calculating the motion of the flexible medium in the conveying path are the Young's modulus, the density, and the thickness of the flexible medium, and these parameters are stored in a database for each kind of the flexible media listed in the medium-selection screen 2H. In FIG. 4, exemplary calculation parameters are as follows. EN100DK, which is a typical recycled paper, is selected as the kind of the medium, and a Young's modulus of 5,409 MPa, a density of $6.8\times10^{-7}$ kg/mm$^3$, and a thickness of 0.0951 mm corresponding to EN100DK are obtained from the database.

Setting Conveyance Conditions

After the flexible medium is divided into the discrete mass-spring elements in the step of creating the flexible-medium model (Step 102), a step of setting conveyance conditions (Step 103) is performed. In this step, driving conditions of the conveyor rollers, the control of the flapper which switches the conveying path, and the coefficients of friction between the flexible medium and the conveyor guides and between the flexible medium and the rollers are defined.

Figure 5:
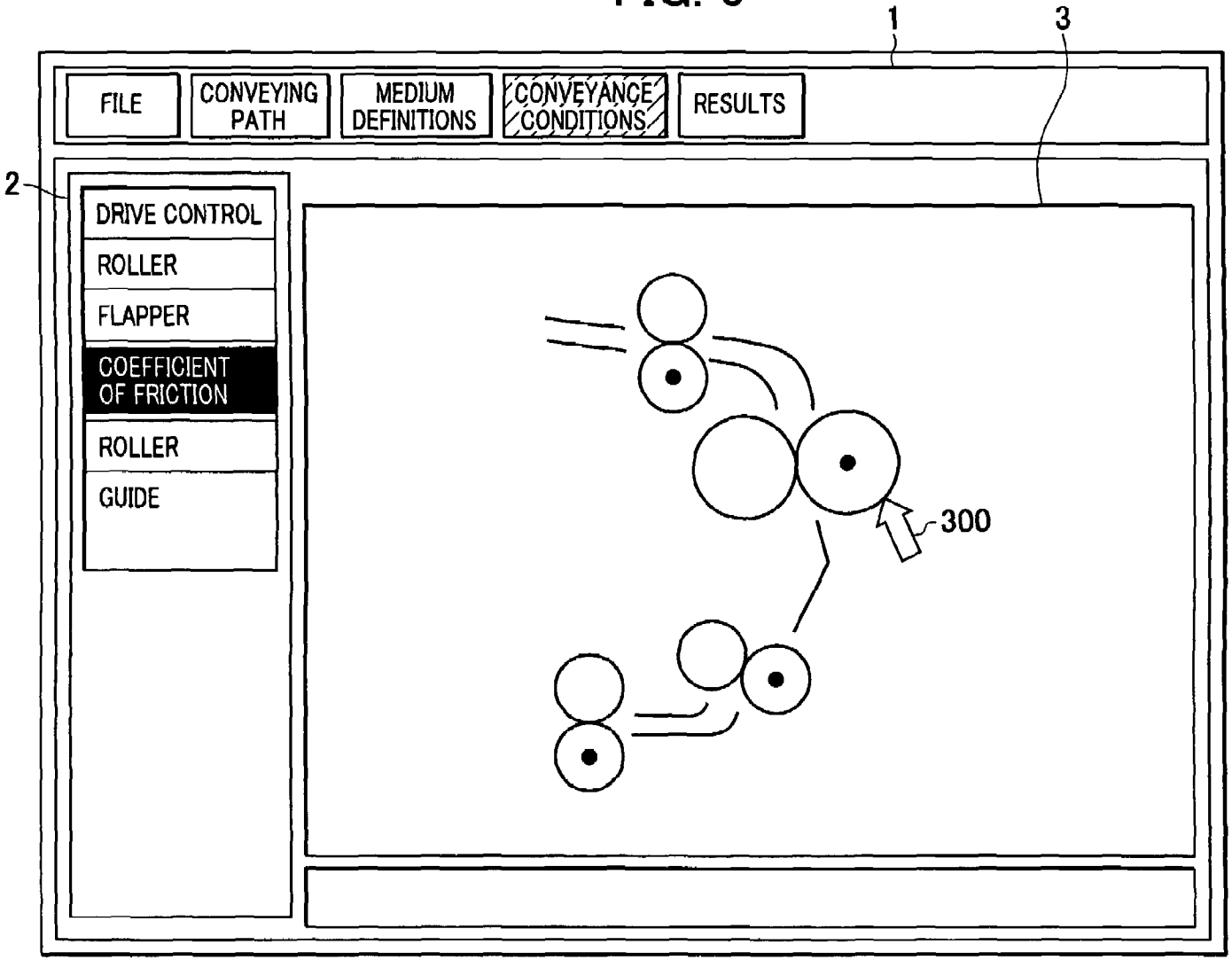
FIG. 5 is a diagram showing an example of a screen for setting a coefficient of friction displayed in a step of defining conveyance conditions according to the first embodiment.

The step of setting the conveyance conditions is started when the "conveyance conditions" button is selected from the menu bar 1, and a list used for defining the driving conditions and the coefficients of friction is displayed in the sub menu 2, as shown in FIG. 5.

Figure 2:
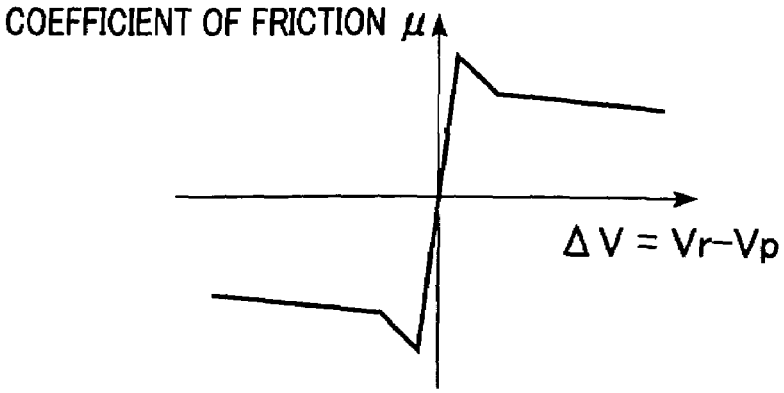
FIG. 2 is a graph which defines the coefficient of friction μ which depends on the difference between the speed of conveyor rollers and the speed of the flexible medium.
Figure 6:
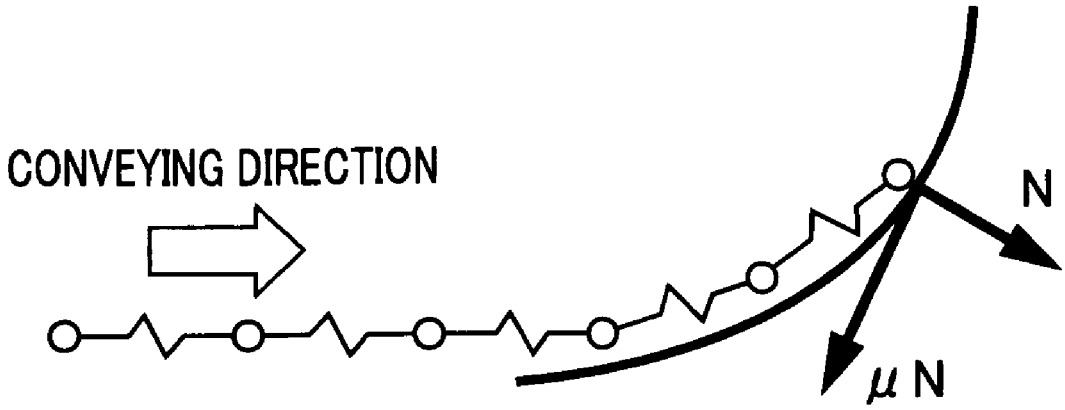
FIG. 6 is a diagram showing the manner in which the frictional force based on the coefficient of friction μ is applied in the first embodiment.

The coefficients of friction are defined by selecting "coefficient of friction" from the list shown in the sub menu 2 with a cursor 300, selecting one of the rollers and guides displayed on the graphic screen 3, and inputting the selected coefficient of friction μ which depends on the speed difference between the flexible medium and the roller or guide, as shown in FIG. 2. When the medium is in contact with one of the guides, as shown in FIG. 6, the frictional force μN, where N is the normal force determined by a contact calculation, is set to be applied in the direction opposite to the conveying direction. When the medium is in contact with one of the rollers in a non-nipping region thereof, the difference ΔV between the speed Vr of the roller and the speed Vp of the medium in the circumferential direction of the roller is calculated. Then, the coefficient of friction μ is determined from FIG. 2 on the basis of the calculated ΔV, and the frictional force μN based on the coefficient of friction μ is set to be applied.

Figure 7A:
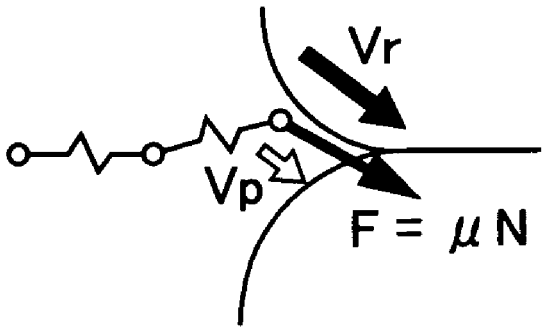
FIGS. 7A and 7B are diagrams showing the manner in which the frictional force is applied to the medium by the conveyor rollers in a non-nipping region in the first embodiment.
Figure 7B:
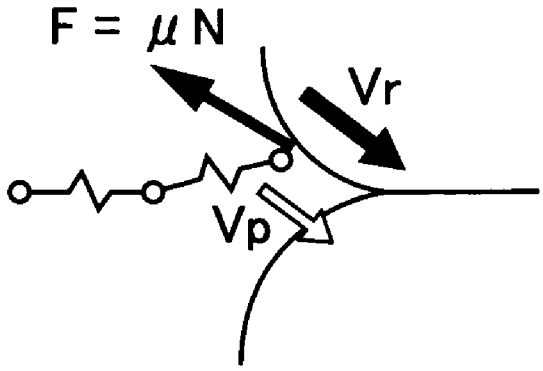

In the simulation, when the peripheral speed Vr of the rollers is higher than the medium's speed Vp, the frictional force μN between the roller and the medium is applied in a direction such that the medium is accelerated in the conveying direction thereof, as shown in FIG. 7A, since the coefficient of friction μ determined from FIG. 2 is positive. When the peripheral speed Vr of the rollers is lower than the medium's speed Vp, the frictional force μN is applied in the direction opposite to the conveying direction of the medium, as shown in FIG. 7B, since the coefficient of friction μ is negative.

The present embodiment is characterized in that the driving conditions are defined in the step of setting the conveyance conditions (Step 103). The method of defining the driving conditions will be described in detail below.

Figure 8:
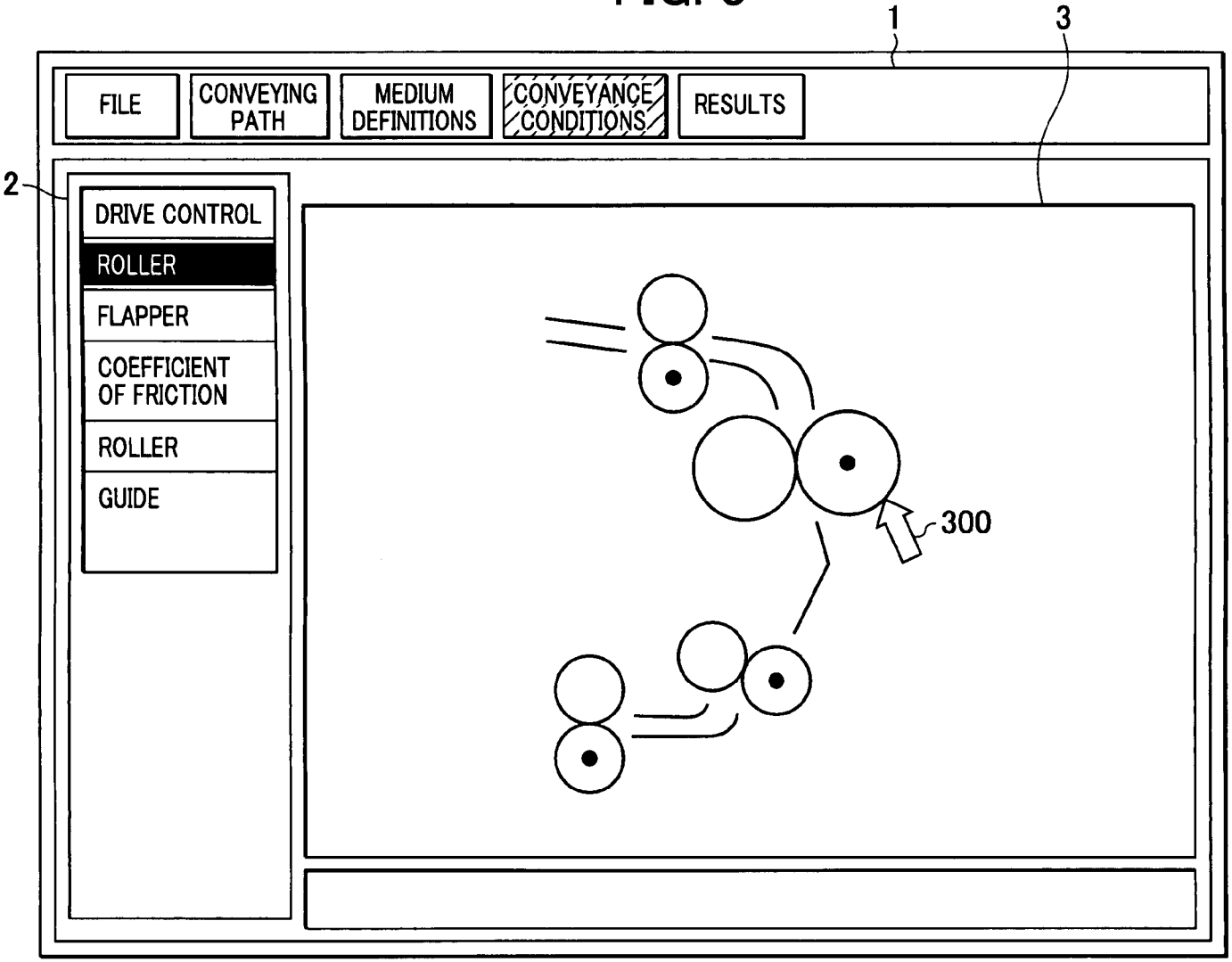
FIG. 8 is a diagram showing an example of a screen for setting driving conditions of the conveyor rollers in the step of defining the conveyance conditions according to the first embodiment.
Figure 9:
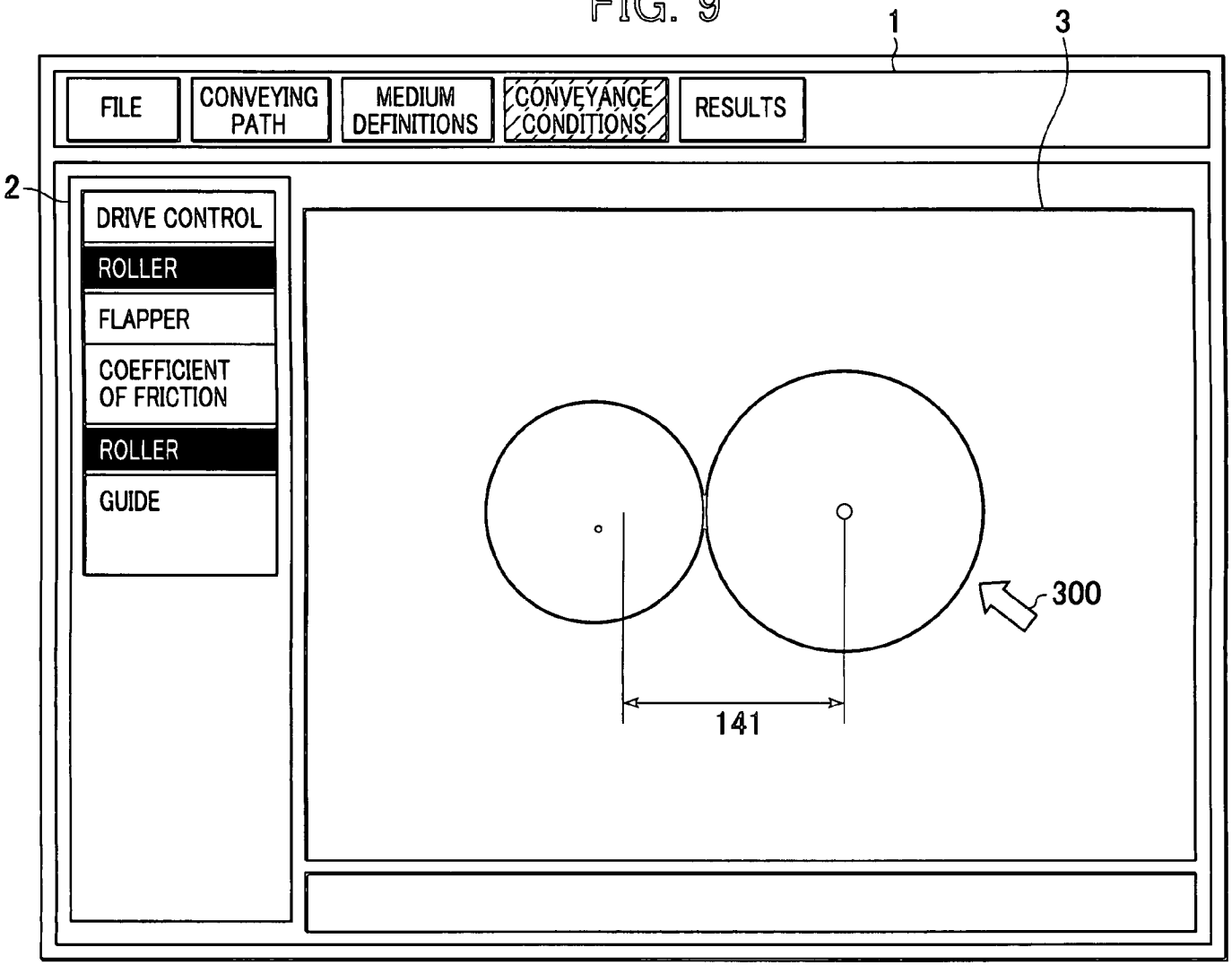
FIG. 9 is a diagram showing a screen for setting the distance between the axes of the conveyor rollers according to the first embodiment.
Figure 10:
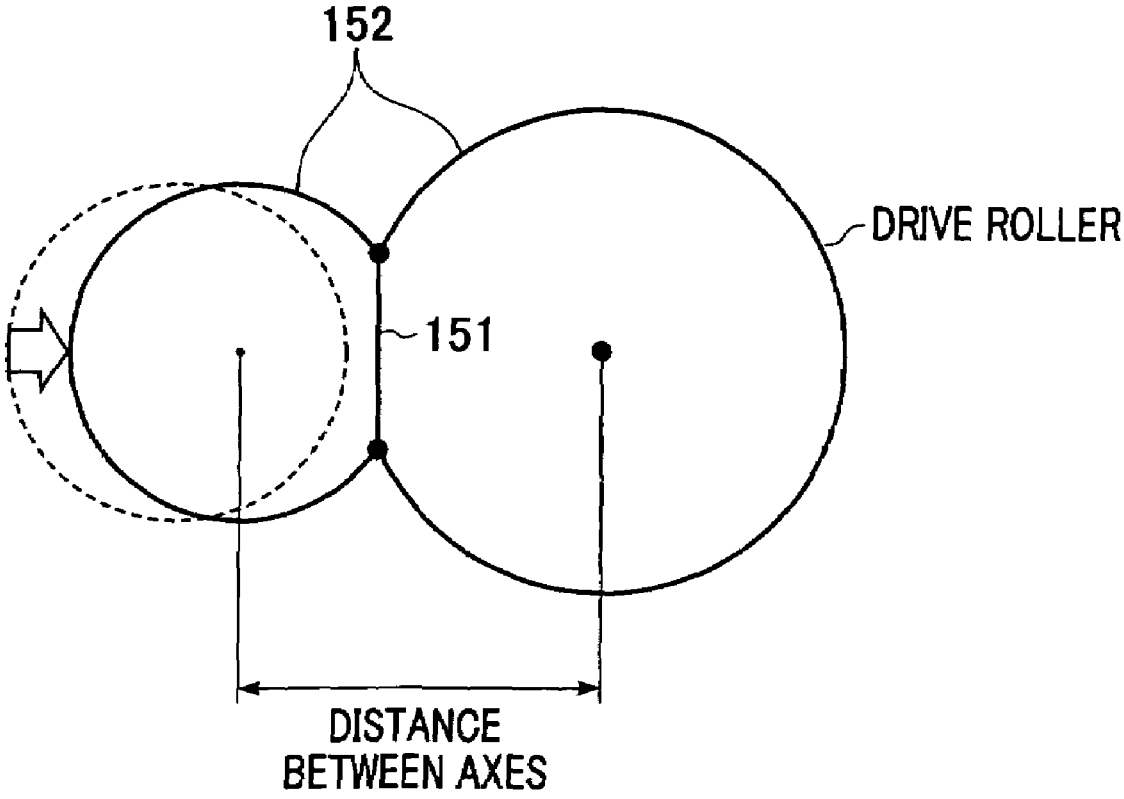
FIG. 10 is a diagram showing the manner in which a nipping region is set on the basis of the distance between the axes of the conveyor rollers in the first embodiment.

FIG. 8 shows an example of a screen for inputting the driving conditions of the rollers according to the present embodiment. First, "roller" is selected from the list shown in the sub menu 2 by moving the cursor 300, and one of the roller pairs whose driving conditions are to be defined is selected from among the conveyor roller pairs displayed on the graphic screen 3. A screen shown in FIG. 9 is displayed when one of the roller pairs is selected, and it is decided which of the two rollers is the drive roller. The other is the driven roller. Then, a distance 141 between the axes of the two rollers when they are pressed against each other with a spring or the like is input. Accordingly, as shown in FIG. 10, the center of the driven roller is moved toward the drive roller so that the distance between the axes of the rollers is reduced to the input distance 141. In addition, an internal process of the system divides the two overlapping circles representing the two rollers into a contact region (nipping region) 151 and a roller surface 152 which corresponds to the non-nipping region.

Figure 11:
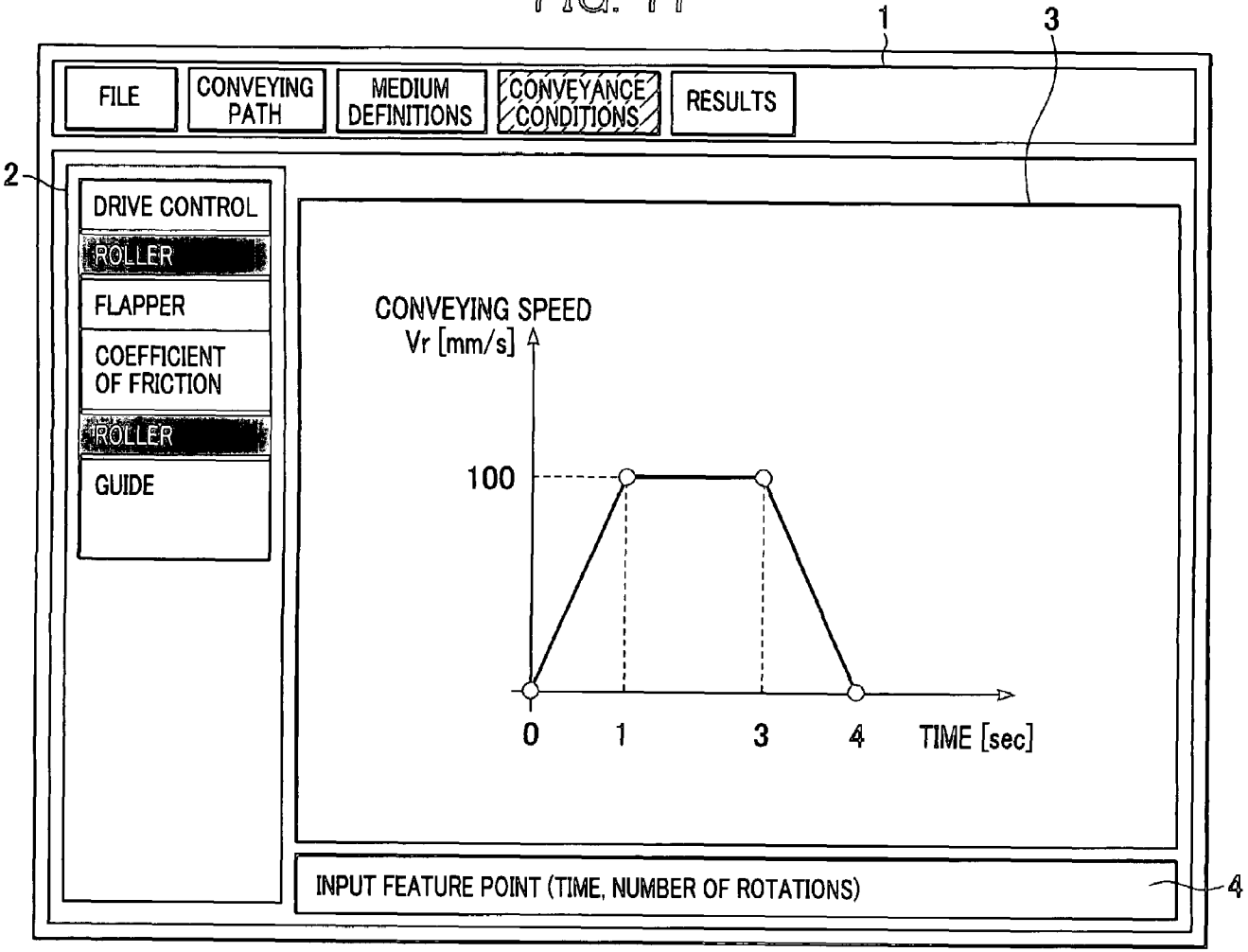
FIG. 11 is a diagram showing an example of the manner in which the speed control is set in the step of defining the conveyance conditions according to the first embodiment.

Next, as shown in FIG. 11, a graph which shows the conveying speed Vr of the rollers versus time is displayed on the graphic screen 3. More specifically, feature points representing the combinations of the time and the conveying speed Vr are successively input in the command column 4, as shown on the graph in the graphic screen 3 accordingly. FIG. 11 shows the case in which the conveying speed is linearly increased from 0 mm/sec to 100 mm/sec in the time interval from 0 seconds to 1 second while the medium is in the non-contact region. The speed is maintained constant at 100 mm/sec in the time interval from 1 second to 3 seconds while the medium is in the contact region, and is reduced from 100 mm/sec to 0 mm/sec in the time interval from 3 seconds to 4 seconds after the medium is released from the rollers.

Motion Calculation and Redividing into Elements

When the various conveyance conditions (the driving conditions and the coefficients of friction) are set in Step 103, the motion of the medium being conveyed is calculated in a step of calculating (simulating) the medium's motion (Step 104). In the present embodiment, when the medium is conveyed to a position near one of the roller pairs, it is determined whether the discrete mass points into which the medium is divided are in contact with the roller surface in the non-nipping region. When one or more of the mass points are in contact with the roller surface, the frictional force based on the difference ΔV between the conveying speed Vr of the rollers and the conveying speed Vp of the medium is applied to each of the mass points which are in contact with the roller surface. Then, when the mass points of the medium move along the roller surface in the non-nipping and enter the nipping region, a boundary condition that the mass points of the medium are forcibly moved at the conveying speed Vr is applied.

The simulation process performed in Step 104 is repeatedly performed after a step of redividing the medium (Step 105). The redividing step is similar to that in the known method for simulating the conveyance of the flexible medium, and explanations thereof are thus omitted.

Displaying Results

Figure 12:
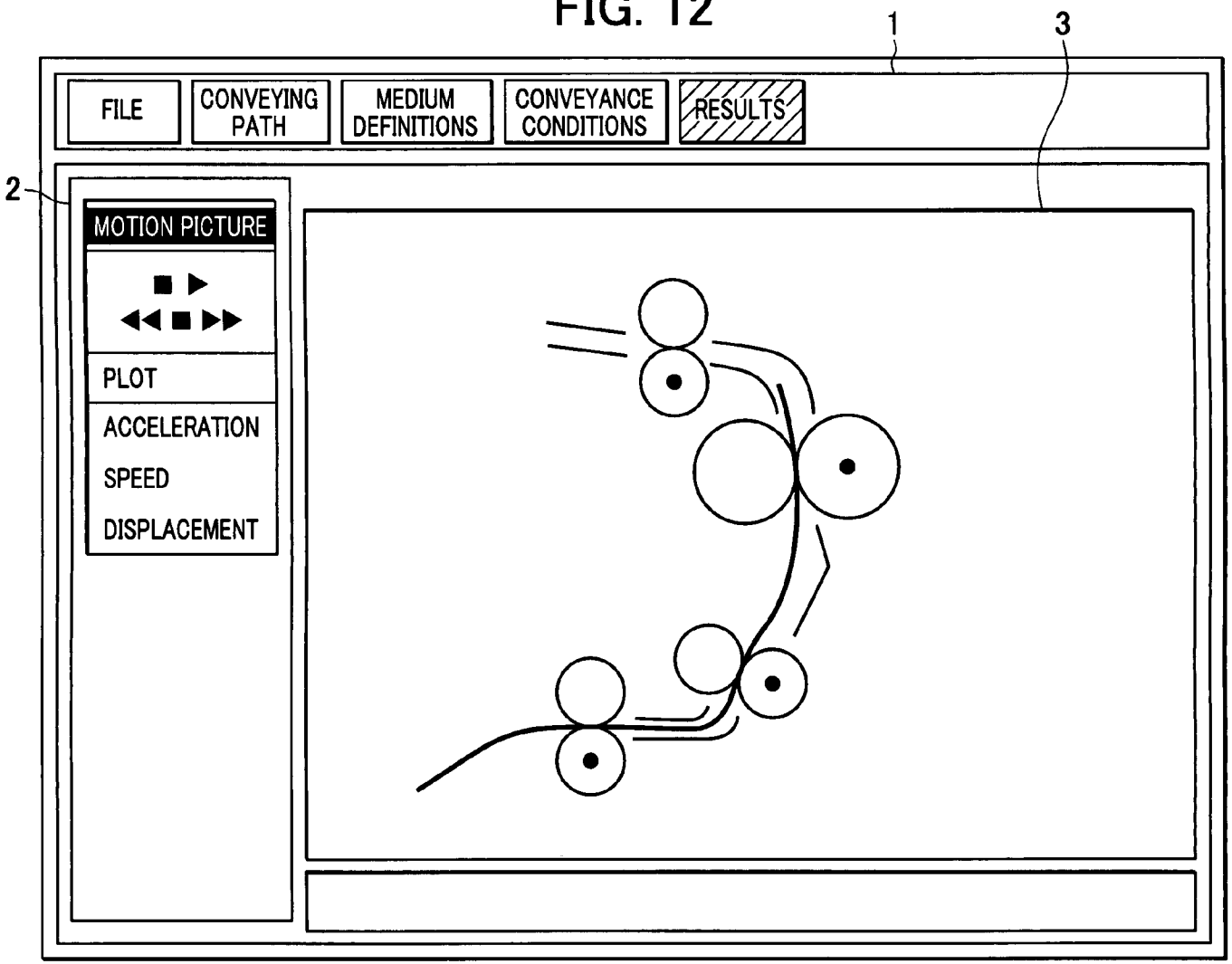
FIG. 12 is a diagram showing an example of a motion picture displayed in a step of displaying results according to the first embodiment.
Figure 13:
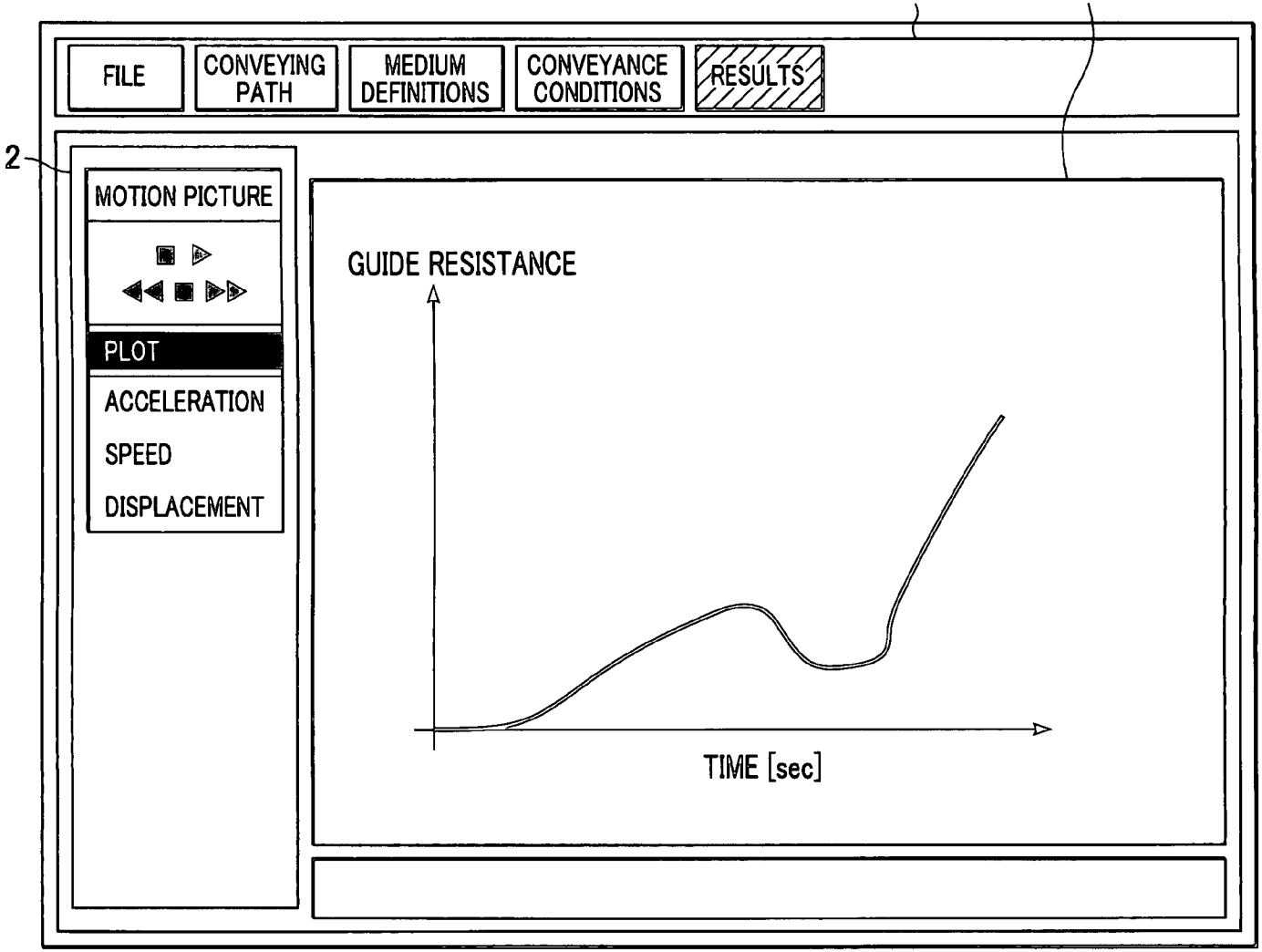
FIG. 13 is a diagram showing an example of a plot menu displayed in the step of displaying the results in the first embodiment.

The thus obtained simulation results of the manner in which the medium is conveyed are displayed on the display 204 in Step 106. The step of displaying the results is performed when a "display results" button is selected from the menu bar 1, and a motion picture menu and a plot menu are displaced in the sub menu 2, as shown in FIG. 12. The motion picture menu shown in FIG. 12 includes a play button, a stop button, a pause button, a fast-forward button, and a reverse button, and the motion of the flexible medium can be visualized on the graphic screen 3 using these buttons. FIG. 13 shows a plot screen according to the present embodiment. In order to show the motion of the flexible medium more quantitatively, graphs showing the conveying load (guide resistance) applied to the rollers and guides, the acceleration, the speed, and the displacement of the flexible medium, etc., versus time are displayed. Accordingly, in the present embodiment, various conveying paths may be evaluated by displaying the results.

Next, a second embodiment of the present invention will be described below. A process of simulating the conveyance of a medium according to the second embodiment is similar to the process of the first embodiment which is shown in the flowchart of FIG. 1, and only differences between the first and the second embodiments will be described below.

Generally, elastic members, such as rubber pieces, are attached to the surfaces of the conveyor rollers, and the rubber pieces deform when the rollers are pressed against each other. Accordingly, due to the influence of the deformation of the rubber pieces, the changes in the environment, the external force applied to the medium, etc., the speed at which the medium is conveyed between the conveyor rollers in the nipping region is different from the peripheral speed of the rollers in the non-nipping region.

Figure 14:
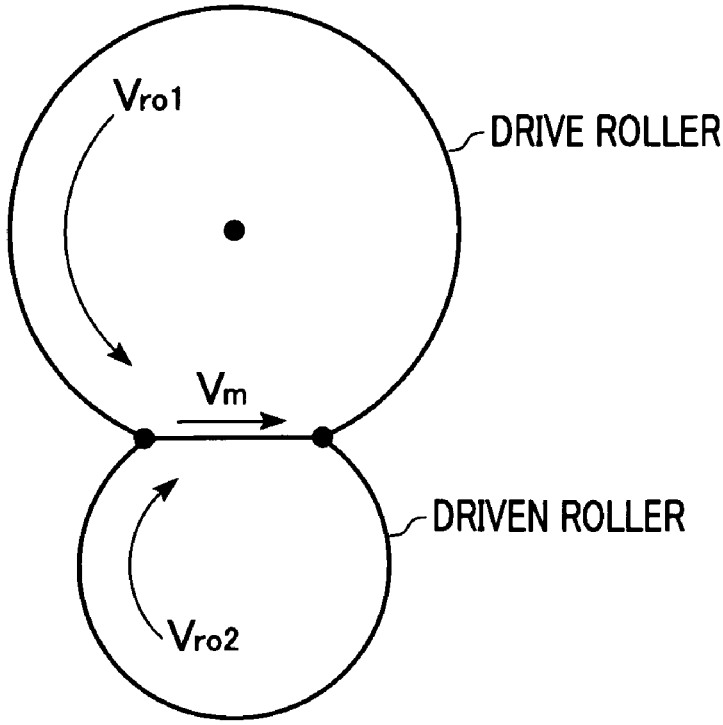
FIG. 14 is a diagram showing the manner in which conveying speeds of the rollers are defined in a second embodiment of the present invention.

Therefore, according to the second embodiment, in order to accurately simulate the actual motion of the medium, the conveying speed Vrn of the rollers in the nipping region and the peripheral speed Vro of the rollers in the non-nipping region are set individually, as shown in FIG. 14, when the driving conditions of the rollers are input in Step 103. In addition, the peripheral speed Vro1 of the drive roller and the peripheral speed Vro2 of the driven roller may be set individually as the peripheral speed in the non-nipping region if necessary.

Thus, according to the second embodiment, the peripheral speed of the conveyor rollers may be input individually for the nipping region and the non-nipping region. In addition, the peripheral speed in the non-nipping region may be input individually for the drive roller and the driven roller forming a pair. Accordingly, the conveying speed of the medium can be more accurately simulated compared to the first embodiment.

Next, a third embodiment of the present invention will be described below. A process of simulating the conveyance of a medium according to the third embodiment is similar to the first embodiment which is shown in the flowchart of FIG. 1, and only the difference between the first and the third embodiments will be described below.

According to the third embodiment, in the step of inputting the driving conditions of the rollers (Step 103), a nip width W is input for determining the nipping region and the center positions of the rollers in the sate in which the conveyor rollers are pressed against each other, instead of inputting the distance 141 between the axes of the rollers as in the first embodiment.

Figure 15:
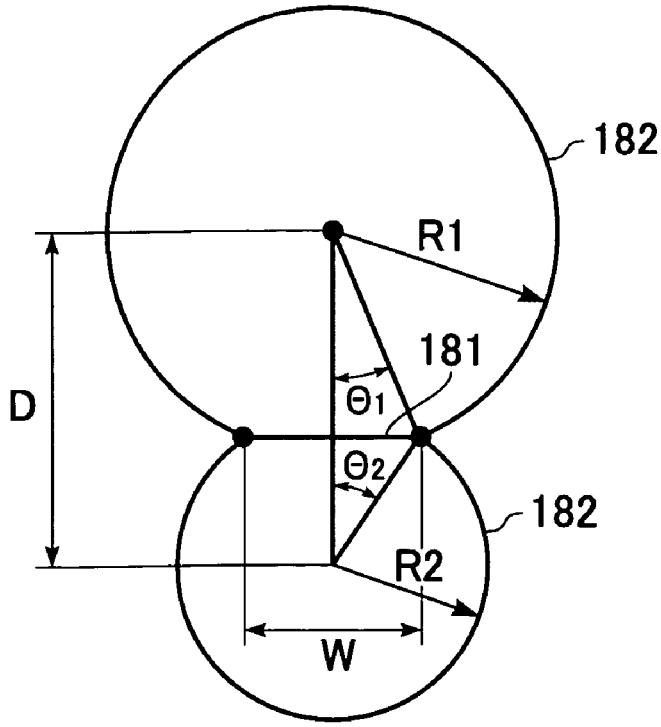
FIG. 15 is a diagram for explaining the manner in which the distance between the axes of the conveyor rollers is calculated using a nip width according to a third embodiment of the present invention.

An example of the nip width W is shown in FIG. 15. With reference to FIG. 15, the distance D between the axes of the rollers can be obtained as follows:

$$D=R1\cdot\cos\theta1+R2\cdot\cos\theta2$$

$$\theta1=\sin^{-1}(W/2R1),\ \theta2=\sin^{-1}(W/2R2)$$

where W is the nip width, R1 and R2 are the radii of the two rollers, and each of θ1 and θ2 is the angle between the line which passes through the center of the corresponding roller and one end of the nip width and the line which connects the centers of the two rollers.

Then, the center of the driven roller is moved such that the distance between the centers of the rollers is reduced to the calculated distance D, and the circles representing the two rollers are divided into a nipping region 181 and a non-nipping region 182. Then, the conveyance of the medium is calculated as in the step of motion calculation (Step 104) according to the first embodiment.

Thus, according to the third embodiment, the size (width) of the nipping region in the conveyor rollers is input and the distance between the axes of the rollers is calculated on the basis of this size. Accordingly, similar to the first embodiment, the conveying speed of the medium can be accurately simulated.

Next, a fourth embodiment of the present invention will be described below. A process of simulating the conveyance of a medium according to the fourth embodiment is similar to the process of the first embodiment which is shown in the flowchart of FIG. 1. In the fourth embodiment, a method for calculating the load torque applied to the conveyor rollers when the conveyance conditions of the conveyor rollers are given as in the first embodiment will be described below.

Figure 16:
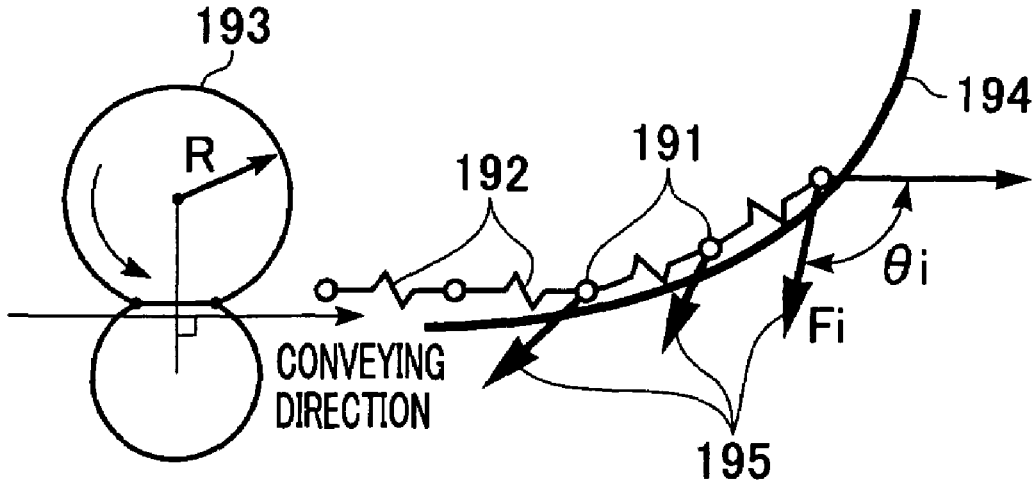
FIG. 16 is a diagram for explaining an algorithm for calculating the load applied to the conveyor rollers according to a fourth embodiment of the present invention.
Figure 17:
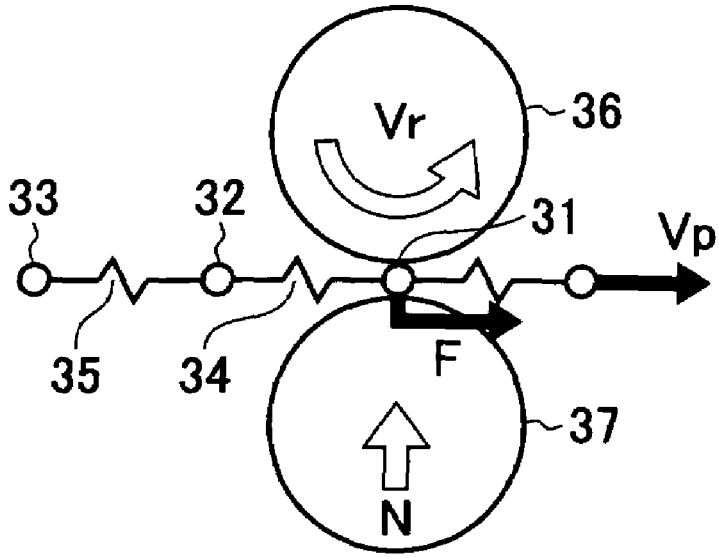
FIG. 17 is a diagram for explaining a known method for simulating the conveyance of a medium.
Figure 18:
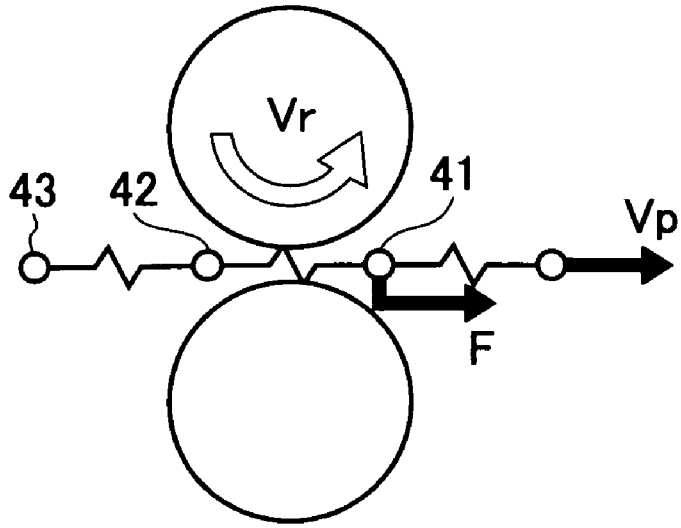
FIG. 18 is another diagram for explaining the known method for simulating the conveyance of the medium.
Figure 19:
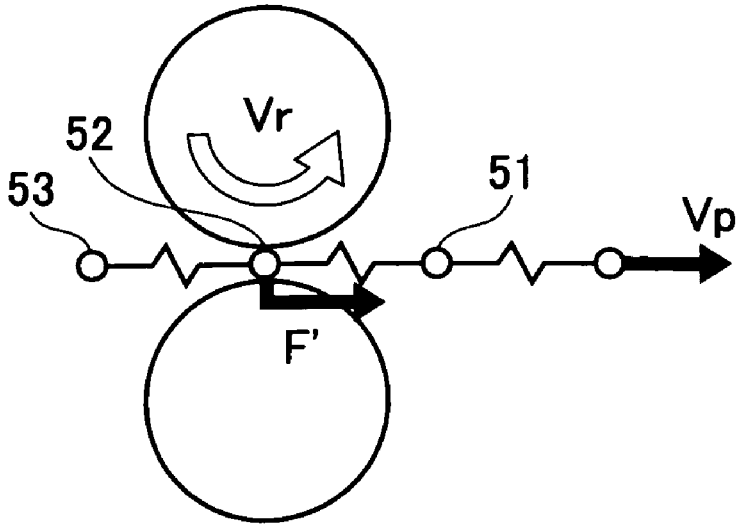
FIG. 19 is another diagram for explaining the known method for simulating the conveyance of the medium.

FIG. 16 is a diagram showing an example of the manner in which the flexible medium is in contact with a guide when the flexible medium is being conveyed. The medium is divided into elements and is modeled with mass points 191 and springs 192. In the figure, reference numeral 193 denotes a pair of conveyor rollers and reference numeral 194 denotes the guide. When the discrete mass points 191 come into contact with the guide 194, each of the mass points 191 which are in contact with the guide 194 individually receives a contact force Fi denoted by 195 in the figure. The load applied to the rollers 193 when the medium is being conveyed is a component of the total contact force in the conveying direction. Accordingly, the load torque applied to the conveyor rollers can be obtained as follows:

$$Tp=-R\sum_{i=1}^{m}Fi\cos\theta i$$

where R is the radius of the drive roller, Fi is the contact force at each mass point, θi is the angle between the direction in which the contact force is applied at each mass point and the conveying direction. The conveying direction is the direction perpendicular to the line connecting the centers of the conveyor rollers 193.

In addition, in the fourth embodiment, the conveying load torque Tp calculated as above and the driving torque T of the drive rollers 193 are compared with each other, and a warning of loss of synchronism of the corresponding drive motor is issued when the load torque Tp exceeds the driving torque T.

As described above, according to the fourth embodiment of the present invention, the conveying load applied to the conveyor rollers is monitored during the conveyance of the flexible medium by calculating the load torque applied to the conveyor rollers on the basis of the force applied to the flexible medium when it is in contact with a guide or a roller in the non-nipping region. Since a warning is issued when the calculated load torque exceeds the driving torque, loss of synchronism of the drive motor can be detected.

The present invention may be applied to a system including a plurality of devices (for example, a host computer, an interface device, a reader, a printer, etc.), as well as to an apparatus consisting of a single device (for example, a copy machine, a facsimile machine, etc.)

The object of the present invention may also be achieved by supplying a system or an apparatus with a storage medium which stores a program code of a software program for implementing the functions of the above-described embodiments and causing a computer (or CPU or MPU) of the system or the apparatus to read and execute the program code stored in the storage medium.

In such a case, the program code itself which is read from the storage medium provides the functions of the above-described embodiments, and thus the storage medium which stores the program code constitutes the present invention.

The storage medium which stores the program code may be, for example, a floppy disk, a hard disk, an optical disk, a magneto-optical disk, a CD-ROM, a CD-R, a magnetic tape, a non-volatile memory card, a ROM, etc.

In addition, the functions of the above-described embodiments may be achieved not only by causing the computer to read and execute the program code but also by causing an operating system (OS) running on the computer to execute some of the process on the basis of instructions of the program code.

Furthermore, the functions of the above-described embodiments may also be achieved by writing the program code read from the storage medium to a memory of a function extension board inserted in the computer or a function extension unit connected to the computer and causing a CPU of the function extension board or the function extension unit to execute some or all of the process on the basis of instructions of the program code.

As described above, according to the above-described embodiments of the present invention, the conveying speed of the medium can be accurately simulated using a stable, forced speed as a conveyance condition under which the medium is conveyed by the conveyor rollers.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A method for simulating the behavior of a flexible medium which is conveyed along a conveying path constructed of a pair of conveyor rollers, the method comprising the steps of:

defining a contact region of the conveyor rollers where the pair of conveyor rollers contact each other and a non-contact region of the conveyor rollers where the pair of conveyor rollers do not contact each other;

setting a first peripheral speed and a second peripheral speed for the contact region and the non-contact region, respectively, the first and the second peripheral speeds being different from each other; and performing a simulation such that a conveying force corresponding to the difference between the second peripheral speed and a speed of the flexible medium is applied to the flexible medium when the flexible medium reaches the non-contact region of the conveyor rollers, such that the flexible medium is conveyed at the first peripheral speed when the flexible medium reaches the contact region of the conveyor rollers.

2. A method according to claim 1, wherein the pair of conveyor rollers consists of a drive roller and a driven roller and the second peripheral speed is set individually for each of the drive roller and the driven roller.

3. A method according to claim 1, wherein the distance between the axes of the conveyor rollers is calculated on the basis of a nip width which is set in advance.

4. A method according to claim 1, further comprising the steps of:

calculating a load torque applied to the conveyor rollers on the basis of a contact force generated when the flexible medium is in contact with a conveyor guide for conveying the flexible medium; and issuing a warning when the calculated load torque is greater than a driving torque of the conveyor rollers, the driving torque being set in advance.

5. A method according to claim 1, further comprising the step of:

calculating a load torque applied to the conveyor rollers on the basis of a contact force generated when the flexible medium is in contact with a conveyor guide for conveying the flexible medium.

6. An apparatus which simulates the behavior of a flexible medium which is conveyed along a conveying path constructed of a pair of conveyor rollers, the apparatus comprising:

a memory which stores a first peripheral speed and a second peripheral speed, the first peripheral speed and the second peripheral speed being different from each other and being set respectively for a contact region of the conveyor rollers where the conveyor rollers contact each other and a non-contact region of the conveyor rollers where the conveyor rollers do not contact each other; and a processor which performs a simulation under a condition that a conveying force corresponding to the difference between the second peripheral speed and a moving speed of the flexible medium is applied to the flexible medium when the flexible medium reaches the non-contact region of the conveyor rollers and a condition that the flexible medium is conveyed at the first peripheral speed when the flexible medium reaches the contact region of the conveyor rollers.

7. An apparatus according to claim 6, wherein the pair of conveyor rollers consists of a drive roller and a driven roller and the memory stores the second peripheral speed for each of the drive roller and the driven roller individually.

8. An apparatus according to claim 6, wherein the processor calculates the distance between the axes of the conveyor rollers on the basis of a nip width which is set in advance.

9. An apparatus according to claim 6, wherein the processor calculates a load torque applied to the conveyor rollers on the basis of a contact force generated when the flexible medium is in contact with a conveyor guide for conveying the flexible medium and issues a warning when the calculated load torque is greater than a driving torque of the conveyor rollers, the driving torque being set in advance.

10. A storage medium which stores a program for executing a method for simulating the behavior of a flexible medium which is conveyed along a conveying path constructed of a pair of conveyor rollers, the program comprising the steps of:

defining a contact region of the conveyor rollers where the pair of conveyor rollers contact each other, and a non-contact region of the conveyor rollers where the pair of conveyor rollers do not contact each other;

setting a first peripheral speed and a second peripheral speed for the contact region and the non-contact region, respectively, the first and the second peripheral speeds being different from each other; and performing a simulation under a condition that a conveying force corresponding to the difference between the second peripheral speed and a moving speed of the flexible medium is applied to the flexible medium when the flexible medium reaches the non-contact region of the conveyor rollers and a condition that the flexible medium is conveyed at the first peripheral speed when the flexible medium reaches the contact region of the conveyor rollers.

* * * * *